US005952976A

United States Patent [19]

Giacino et al.

[11] Patent Number: 5,952,976

[45] Date of Patent: Sep. 14, 1999

[54] HELICOPTER FURNISHED WITH A HIGH-FREQUENCY RADIOCOMMUNICATION SYSTEM

[75] Inventors: Thomas Giacino, Calas; Hervé Guy Dutruc, Ensues la Redonne, both of France

[73] Assignee: Eurocopter France, Marignane Cedex, France

[21] Appl. No.: 08/760,750

[22] Filed: Dec. 5, 1996

[30] Foreign Application Priority Data

Dec. 27, 1995 [FR] France ..... 95 15541

[51] Int. Cl.[6] ..... H01Q 1/28

[52] U.S. Cl. ..... 343/705; 343/708

[58] Field of Search ..... 343/705, 708, 343/833, 834

[56] References Cited

U.S. PATENT DOCUMENTS

| | | | |
|---|---|---|---|
| 2,745,102 | 5/1956 | Norgorden | 343/834 |
| 2,770,801 | 11/1956 | Jones | 343/834 |
| 3,823,402 | 7/1974 | Tharp | 343/705 |
| 4,117,490 | 9/1978 | Arnold et al. | 343/708 |
| 4,288,794 | 9/1981 | Osborne et al. | 343/708 |
| 5,231,413 | 7/1993 | Dubois | 343/833 |

FOREIGN PATENT DOCUMENTS

| | | |
|---|---|---|
| 2655778 | 6/1991 | France . |
| 4339162 | 5/1995 | Germany . |

*Primary Examiner*—Michael C. Wimer
*Attorney, Agent, or Firm*—Fisher, Christen & Sabol

[57] ABSTRACT

The objective of the invention is to compensate for the attenuation, in a direction (X,X), of the radiation from an antenna (5) mounted on a helicopter (1), including elements (12) which disturb the propagation of electromagnetic waves. According to the invention, at least one conducting wire (14) is fixed on the structure (1) of said helicopter, in proximity to said antenna (5), and positioned so that the electromagnetic interaction between said antenna (5) and said conducting wire (14) at least partially compensates for said attenuation of radiation.

11 Claims, 2 Drawing Sheets

HELICOPTER FURNISHED WITH A HIGH-FREQUENCY RADIOCOMMUNICATION SYSTEM

FIELD OF THE INVENTION

The present-invention relates to means making it possible to compensate for the attenuation, in at least one direction, of the radiation from an antenna associated with a high-frequency radiocommunication system and mounted on a helicopter whose elements give rise to the said attenuation of radiation. Hereafter, "high frequency" will be understood to mean a frequency lying within the ranges of very high frequencies (VHF) or ultrahigh frequencies (UHF), especially between 100 MHz and 400 MHz.

PRIOR ART

It is known that, in helicopters, provision is made for VHF and/or UHF radiocommunication systems whose antennae are mounted on the outside surface of said helicopters. It is known moreover that, owing to the shape of such a helicopter and to the arrangement of said antennae thereon, electrically conducting or weakly electrically conducting elements (elements made of carbon, for example) of its structure may lie on the path of propagation of the electromagnetic field of said antennae, so that these elements are obstacles to this propagation and bring about attenuation of the radiation from said antennae. Such an attenuation can also occur in the presence of a body of composite material which is electrically non-conducting.

BROAD DESCRIPTION OF THE INVENTION

The objective of the present invention is to remedy this drawback and to increase the gain of an antenna in a specified direction so as to compensate for a reduction in this gain due to the presence of the disturbing elements of the structure of the helicopter.

For this purpose, according to the invention, the helicopter furnished with a high-frequency radiocommunication system associated with an antenna fixed on the structure of said helicopter, the radiation from said antenna being attenuated in at least one direction on account of the presence of disturbing elements belonging to said helicopter, is noteworthy in that it includes, in proximity to said antenna, at least one conducting wire positioned on said helicopter, and wherein the distance between said conducting wire and said antenna is:

- between 0.2 m and 1.6 m, when the frequency of the radiocommunication system is between 100 and 200 MHz; and
- between 0.1 m and 0.9 m, when said frequency is between 200 and 400 MHz, so that the electromagnetic interaction between said antenna and said conducting wire at least partially compensates for the attenuation of the radiation from said antenna in said direction of attenuation.

Thus, according to the invention, said conducting wire makes it possible to increase the gain of said antenna in the direction of the attenuation.

Said conducting wire may not be energized by said radiocommunication system and be, for example, connected to the electrical ground of the structure of the helicopter, for reasons of simplicity of construction. It may, as a variant, be energized by said radiocommunication system, but with a phase-shift (lag) with respect to the energizing of said antenna.

Preferably, said antenna and said conducting wire determine a plane incorporating said direction in which the radiation from the antenna undergoes the attenuation. They may be parallel.

Advantageously, said conducting wire is arranged between said antenna and said disturbing elements of the structure. However, in some cases, this conducting wire may be arranged on the side opposite to said disturbing elements with respect to said antenna.

Implementation of the invention is particularly beneficial when the helicopter includes a bulbous body extended by an elongate tail and when said antenna is fixed beneath said elongate tail, in such a way that the radiation from said antenna is attenuated at least fore of said helicopter on account of the presence of the lower part of said bulbous body. Thus, in this case, the radio links between the helicopter and a ground station situated, far off, fore of said helicopter, may be strongly reduced.

Thus, in such a case, in order to improve this kind of radio link, there is provided, in proximity to said antenna, at least one conducting wire positioned beneath said elongate tail, so that the electromagnetic interaction between said antenna and said conducting wire at least partially compensates for the attenuation of the radiation from said antenna fore of said helicopter.

Such a conducting wire can be incorporated into or consist of a projecting member of said helicopter, for example a cable cutter.

BRIEF DESCRIPTION OF THE DRAWINGS

The figures of the appended drawing will elucidate the manner in which the invention may be realized. In these figures, identical references denote similar elements.

DESCRIPTION OF THE PREFERRED EMBODIMENT

Figure 1:
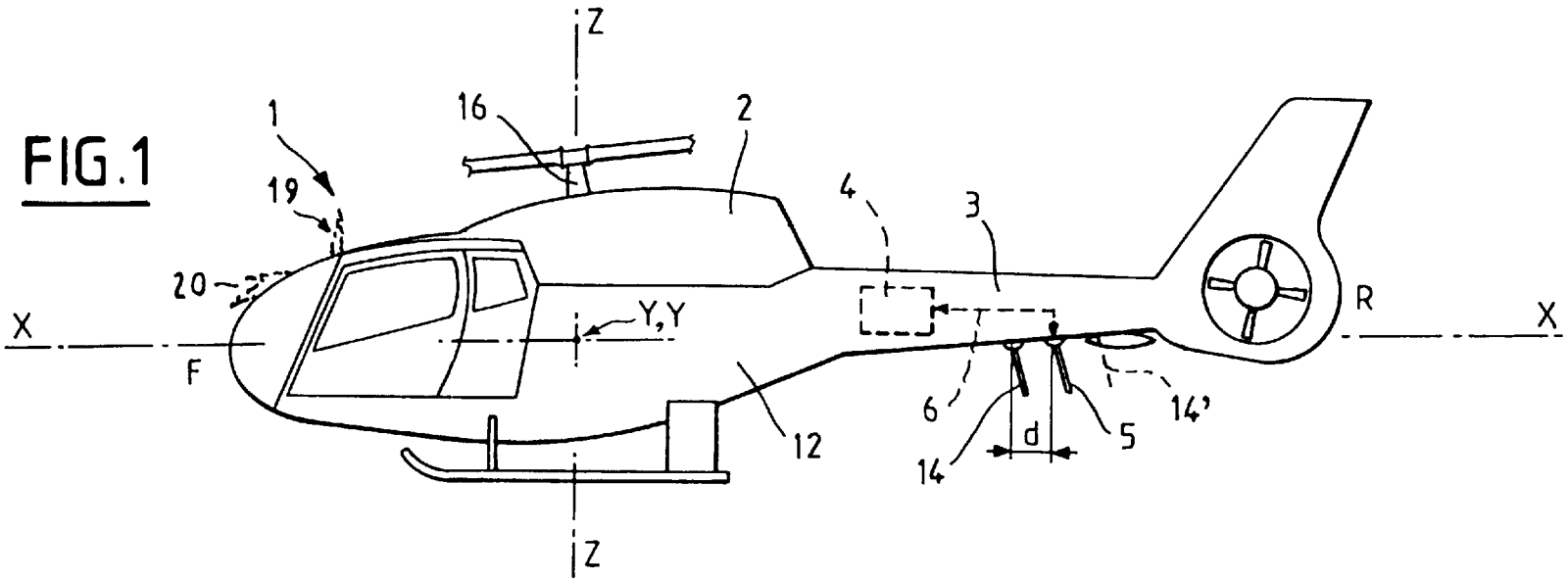
FIGS. 1 and 2 show diagrammatically, respectively in side elevation and in plan view, a heliopter in accordance with the present invention.
Figure 2:
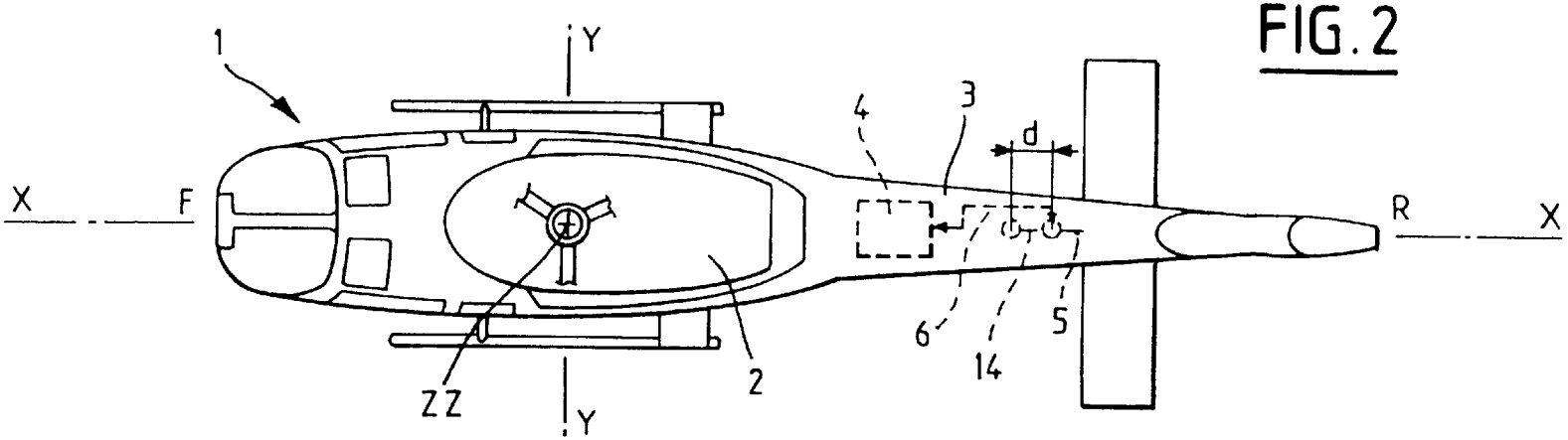

The helicopter 1, shown diagrammatically in FIGS. 1 and 2, includes in the usual manner a bulbous body 2, extended rearward by an elongate tail 3, and has a longitudinal axis X,X, a transverse pitching axis Y,Y and a vertical yawing axis Z,Z. The helicopter 1 includes a radiocommunication system 4, operating in the VHF and/or UHF frequency bands, lying between 100 MHz and 400 MHz. The radiocommunication system 4 comprises an antenna 5, fixed to the lower part of the elongate tail 3 and connected to said radiocommunication system 4 by a link 6.

Figure 3:
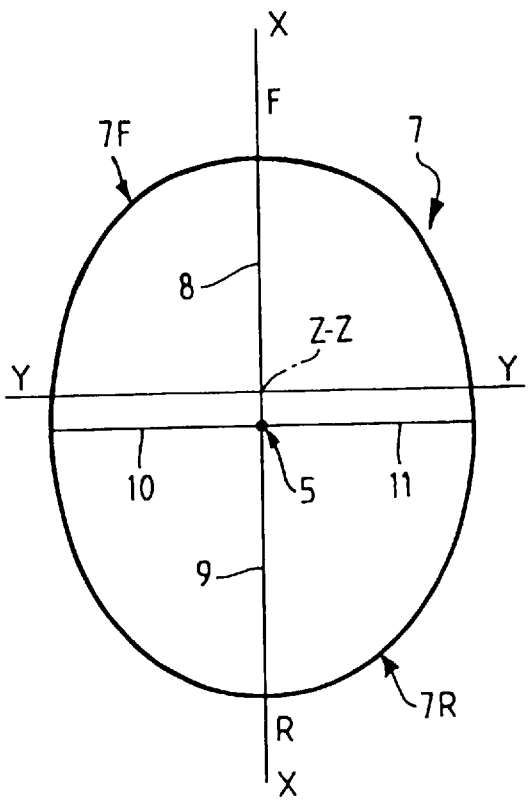

If the antenna 5 were isolated or else in the hypothetical case in which the body 2 of the helicopter were to include no disturbing element, the radiation pattern of the antenna 5, in the plane X,X, Y,Y would, in the known manner, have the approximately ellipsoidal shape of curve 7, represented in FIG. 3. This curve 7 is centered on the antenna 5 and its major axes 8 and 9 run parallel to the longitudinal axis X,X, or along the latter if said antenna 5 is in the plane X,X; Z,Z, respectively fore F and aft R of the helicopter 1. The minor axis 10 and 11 of curve 7 run parallel to the transverse pitching axis Y,Y and delimit the forward part 7F and the rear part 7R of said curve 7.

However, in reality, the body 2 of the helicopter includes numerous disturbing elements, which are electrically conducting or non-conducting, so that, on account of the respective shapes and arrangements of the body 2 and the tail 3, the propagation of the electromagnetic waves emitted and/or received by the antenna 5 may be strongly disturbed, on the forward side F, by said disturbing elements of the lower part 12 of the body 2.

As a result, fore F of the helicopter 1 there is a reduction in gain of the antenna 5 and an attenuation of the radiation from the latter.

Figure 4:
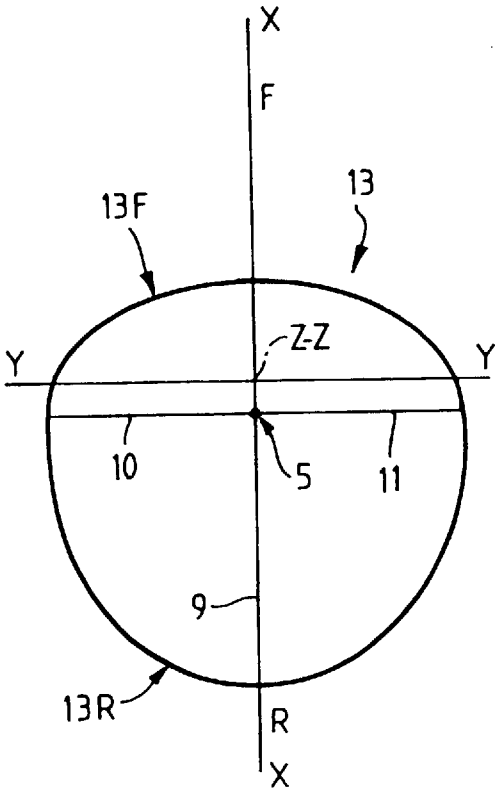

The radiation pattern of the antenna 5 in the plane X,X; Y,Y then has the shape of curve 13 of FIG. 4, the rear part 13R of which is substantially similar to the rear part 7R of curve 7, but whose forward part 13F is flattened, in relation to this rear part 13R and to the forward part 7F of the curve 7.

In order to remedy this drawback, according to the invention, a conducting wire 14, for example connected to the ground of the helicopter 1, is provided beneath the tail 3 in proximity to the antenna 5 and parallel thereto.

In this example, as may be seen in FIGS. 1 and 2, the antenna 5 and conducting wire 14 lie in the plane X,X; Z,Z incorporating the longitudinal axis X,X. Moreover, the conducting wire 14 is arranged between the antenna 5 and the lower part 12 of the body 2, which includes disturbing elements.

Figure 5:
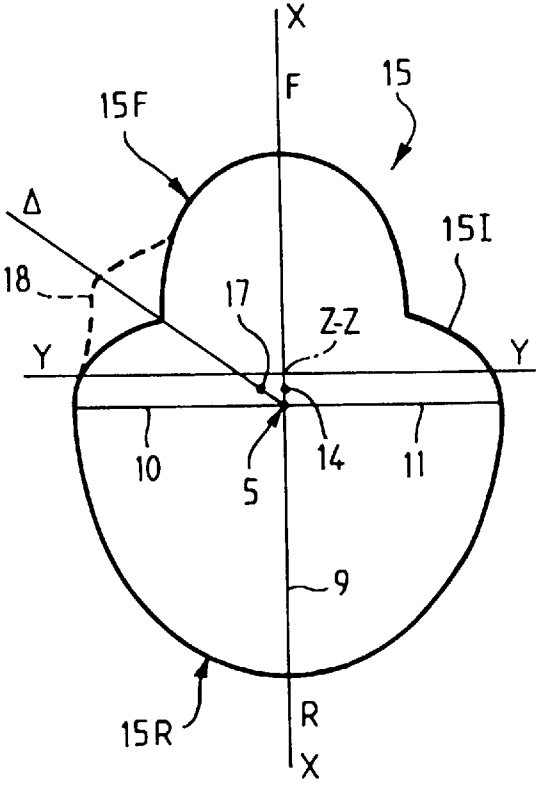
FIGS. 3, 4 and 5 illustrate diagrammatically various radiation patterns of one and the same antenna, depending on whether the latter is isolated (FIG. 3), is mounted beneath the tail boom of the helicopter of FIGS. 1 and 2 (FIG. 4), or else is associated with a conducting wire, non-energized or energized with a phase lag, in accordance with the present invention.

If, now, the radiation pattern of the antenna 5 (energized by the system 4) associated with the wire 14 (non-energized) is plotted, a curve similar to that bearing the reference 15 of FIG. 5 can be obtained. This curve 15 has a rear part 15R, substantially similar to the rear parts 7R and 13R of patterns 7 and 13, and a forward part 15F projecting strongly forwards F in relation to the corresponding forward part 13F of the pattern 13, this forward part 15F being connected to the rear part 15R by an intermediate part 151, substantially similar to the lateral parts of the forward part 13F of pattern 13.

The increase in the gain of the antenna 5, illustrated by the curve portion 15F, is engendered by the electromagnetic interaction between the antenna 5 and the conducting wire 14. This increase in gain can be several dB, for example of the order of 5 dB, which at least partially compensates for the attenuation due to the lower part 12 of the body 2, as shown by comparing FIGS. 3, 4 and 5.

It will be noted that the compensation for the attenutation of the radiation from the antenna could also be obtained by arranging the conducting wire 14 on the opposite side of the antenna 5 to the body 2 (at 14') rather than between the lower part 12 and the antenna 5.

In general, the results obtained are satisfactory if the conducting wire 14 is located, fore or aft of the antenna 5, at a distance d from said antenna 5 of between 0.2 m and 1.6 m for frequencies of between 100 and 200 MHz (more particularly between 118 and 174 MHz) and between 0.1 m and 0.9 m for frequencies of between 200 and 400 MHz (more particularly between 225 and 400 MHz).

Of course, the exact value of the distance d for optimal compensation for the attenuation due to the lower part 12 of the body 2 is tightly bound with the nature (shape, constituent materials, etc.) of the helicopter 1.

Furthermore, in a helicopter, elements other than the lower part 12 of the body 2 may be the cause of attenuation of radiation from antennas. For example, the mast of the main rotor 16, as well as the main transmission gearbox, are the main causes of the attenuations of the radiation patterns of antennae positioned on the cowling of the engine (attenuation in the forward sector) or on the roof of the cabin (attenuation in the aft sector). In similar fashion to what was described above, these attenuations can be reduced, or even compensated for, by positioning a conducting wire, connected to ground or energized in a phase-shifted manner relative to the antenna, in the direction of the attenuation or in the direction opposite to the attenuation.

For example, for a VHF/AM (118–137 MHz) antenna positioned on the cowling of the engine, it is possible to compensate for the attenuations by 4 dB in the forward sector and by 3 dB in the aft sector by positioning the conducting wire around 35 cm behind the initial antenna.

Represented moreover in FIG. 1 is a VHF and/or UHF antenna 19 arranged at the front of the body 1, on the top side. In the manner described above with regard to the antenna 5, it is possible to compensate for attenuation of radiation from the antenna 19 by associating therewith a conducting wire, similar to the conducting wire 14. In this example, said conducting wire (not visible) associated with the antenna 19 is incorporated into a cable cutter 20.

It goes without saying that, as FIG. 5 shows, if it is desired to compensate still further for the attenuation of the radiation from the antenna 5, for example in the lateral direction Δ, it is possible to provide a complementary lateral conducting wire 17 operating identically to the conducting wire 14 and affording compensation illustrated by the curve portion 18.

We claim:

1. A helicopter (1) furnished with a high-frequency radiocommunication system (4) associated with an antenna (5) fixed on the body of said helicopter, the radiation from said antenna (5) being attenuated in at least one direction (X, X) on account of the presence of disturbing elements (12) belonging to said body, said helicopter including, in proximity to said antenna (5), at least one conducting wire (14) positioned on said helicopter, wherein the distance (d) between said conducting wire (14) and said antenna (5) is:

between 0.2 meters and 1.6 meters, when the frequency of the radiocommunication system is between 100 and 200 MHz; and between 0.1 m and 0.9 m, when said frequency is between 200 and 400 MHz, so that the electromagnetic interaction between said antenna (5) and said conducting wire (14) at least partially compensates for the attenuation of the radiation from said antenna (5) in said direction of attenuation.

2. The helicopter as claimed in claim 1, wherein said conducting wire (14) is not energized by said radiocommunication system.

3. The helicopter as claimed in claim 1, wherein said conducting wire (14) is connected to the ground of said helicopter (1).

4. The helicopter as claimed in claim 1, wherein said conducting wire (14) is energized by said radiocommunication system (4), with a phase-shift with respect to the energizing of said antenna (5).

5. The helicopter as claimed in claim 1, wherein said antenna (5) and the conducting wire (14) determine a plane (X,X; Z,Z) incorporating said direction (X,X).

6. The helicopter as claimed in claim 5, wherein said antenna (5) and said conducting wire (14) are parallel.

7. The helicopter as claimed in claim 1, wherein the conducting wire (14) is arranged between said antenna (5) and said disturbing elements (12).

8. The helicopter as claimed in claim 1, wherein said conducting wire (14) is arranged on the opposite side to said disturbing elements (12) with respect to said antenna (5).

9. The helicopter (1) as claimed in claim 1, which includes a bulbous body (2) extended by an elongate tail (3) and in which said antenna (5) is fixed beneath said elongate tail, in such a way that the radiation from said antenna (5) is attenuated at least fore (F) of said helicopter on account of the presence of the lower part (12) of said bulbous body (2), wherein said conducting wire (14) is fixed beneath said elongate tail (3) in order at least partially to compensate for said attenuation fore (F) of said helicopter (1).

10. The helicopter (1) as claimed in claim 1, wherein said conducting wire (14) is incorporated into a projecting member (20) of said helicopter.

11. The helicopter (1) as claimed in claim 10, wherein said projecting member (20) is a cable cutter.

* * * * *